United States Patent [19]

Droeser

[11] Patent Number: 4,538,319

[45] Date of Patent: Sep. 3, 1985

[54] ROLLER BRUSH FOR SWEEPING MACHINES

[76] Inventor: Walter Droeser, Ragnaröksgatan 7, S-72355 Västerås, Sweden

[21] Appl. No.: 584,388

[22] Filed: Feb. 28, 1984

[30] Foreign Application Priority Data

Mar. 8, 1983 [SE] Sweden ..... 8301258

[51] Int. Cl.[3] ..... A46B 13/02

[52] U.S. Cl. ..... 15/183

[58] Field of Search ..... 15/179, 180, 181, 182, 15/183, 198, 200

[56] References Cited

U.S. PATENT DOCUMENTS 3,225,389 12/1965 Jones ..... 15/183 X
4,302,863 12/1981 Droeser ..... 15/183

FOREIGN PATENT DOCUMENTS 353026 5/1961 Switzerland ..... 15/183
814113 5/1959 United Kingdom ..... 15/183

*Primary Examiner*—Peter Feldman
*Attorney, Agent, or Firm*—Young & Thompson

[57] ABSTRACT

A roller brush comprises a central tube and a plurality of uniformly distributed axial light-metal sections removably clamped against each other and against the tube by means of wedges. Axial bristle bars with bristle bundles are arranged between the outer end portions of the sections. The bristle bars have a substantially rectangular cross section and have their side edges displaceably mounted in retaining bars made from plastics, which in turn are accommodated in grooves made in the sides of the light-metal sections.

1 Claim, 3 Drawing Figures

ROLLER BRUSH FOR SWEEPING MACHINES

The present invention relates to a roller brush of the kind disclosed in the preamble to the following main claim and is intended for sweeping machines.

Such a roller brush is known, e.g. through the published Swedish patent application No. 7905644-6, which illustrates a rotatably mounted central tube provided with a number of welded-on ring flanges having at their edges cutouts for axial guide members which are welded to the flanges. The guide members form opposing pairs of open slots for the reception of bristle bars provided with a row of bristle bundles.

The roller brushes in question are subjected to considerable forces and vibrations. The welded joints particularly involve the risk of rupture due to fatigue, but fatigue rupture can also be obtained in the ring flanges. Furthermore, the welding operation means that it takes relatively long working time to manufacture such a roller brush. The welded joints also have the disadvantage that they make the exchange of damaged parts more difficult.

The object of the present invention is therefore to provide a roller brush which is constructed substantially without the aid of welded joints and which makes it possible to change different parts in a simple manner when necessary.

This is achieved with a roller brush which, according to the invention, has the characterizing features disclosed in the following claim.

In contradistinction to the known roller brush, the one in accordance with the invention lacks welded-on ring flanges for carrying the bristle bars at a desired radial distance from the central tube. Instead, a number of axial light metal sections are used, equal in number to the number of bristle bars provided. These sections are removably clamped to the central tube and to each other by wedges which are urged against wedging surfaces on the sections with the aid of screws which can be screwed into threaded holes in the tube.

The light-metal sections have a radially outward end portion which is provided with axial grooves on either side, retaining bars of plastics being arranged in the grooves. Retaining bars, which are placed opposite each other, have open channels for receiving displaceable bristle bars. The radially outwardly directed sides of the bristle bars and sections thus form a cohesive exterior surface preventing dirt, snow and water from penetrating down into the space between the bristle bars and the central tube, which is possible with the known roller brush. This is not desirable however, since large collections of dust and ice can cause imbalance in the roller brush during its rotation.

The central tube can be manufactured with relatively good precision, and clamping the axial sections with the aid of the wedges can also take place with good precision. The sections are manufactured with great dimensional accuracy. The result will thus be that without the aid of welds, the sections can be fitted with the plastics retaining bars in place, so that the opposing retaining channels in the bars will form retention with good dimensional accuracy for the respective bristle bar. The sections extend along the whole of the length of the central tube, and since they are clamped together into one unit, they will form solid support for the bristle bars along their entire length. The bristle bars thus do not need to contribute in taking up any occurring bending forces, resulting in that they can be manufactured with considerably less wall thickness than with the bristle bars of the known roller brush. Since the retaining bars are of plastics, a given play can be allowed, however, in the channels of the bars without the risk of notable wear.

Since neither the retaining bars nor the bristle bars are free between any pair of support points, but have solid support from the sections along the whole of their length, the bristle bars cannot be deformed by bending, resulting in that they are always straight and thus may be easily drawn out from the retaining bars or thrust into them.

These and other distinguishing details and advantages of the invention will now be described in more detail with reference to an embodiment illustrated on the accompanying drawings as an example of a roller brush in accordance with the invention.

The roller brush has a central tube 10 which is rotatably mounted as in the prior art.

Around the circumference of the tube there are removably fastened a number of uniformly distributed light-metal sections 11. The length of the sections is approximately equal to that of the tube.

Figure 3:
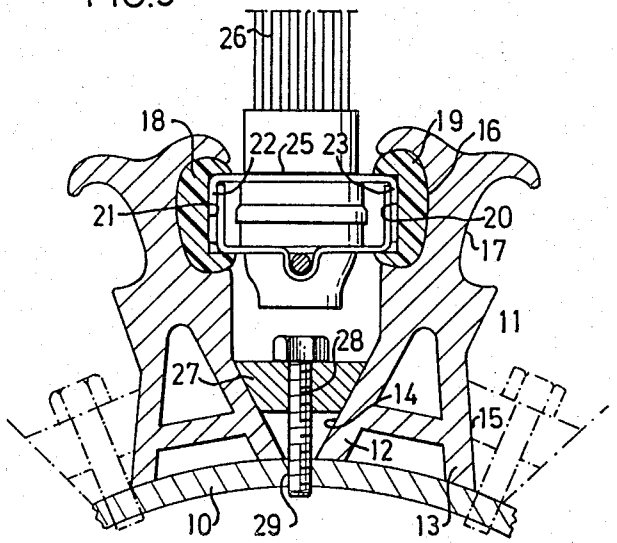
FIG. 3 is an enlarged detail depiction of the roller brush in FIG. 1.

Since the sections are of light metal, they can be manufactured in a simple an inexpensive way with the cross section depicted in FIG. 3. The cross section of the sections is symmetrical and has a foot end with two legs 12,13 engaging against the tube. The two exterior sides 14,15 of the foot end diverge radially outwards and form wedge surfaces.

The upper end portion of the sections is formed on either side with bowl-shaped grooves 16,17. These grooves accommodate plastic bars 18,19 which have channels 20,21 on their outer sides for receiving the respective side edge portion 22,23 of a bristle bar 25, which is substantially rectangular in cross section and is of the kind more closely apparent from the published Swedish patent application No. 7905644-6. The bristle bars carry a plurality of bristle bundles 26.

Figure 1:
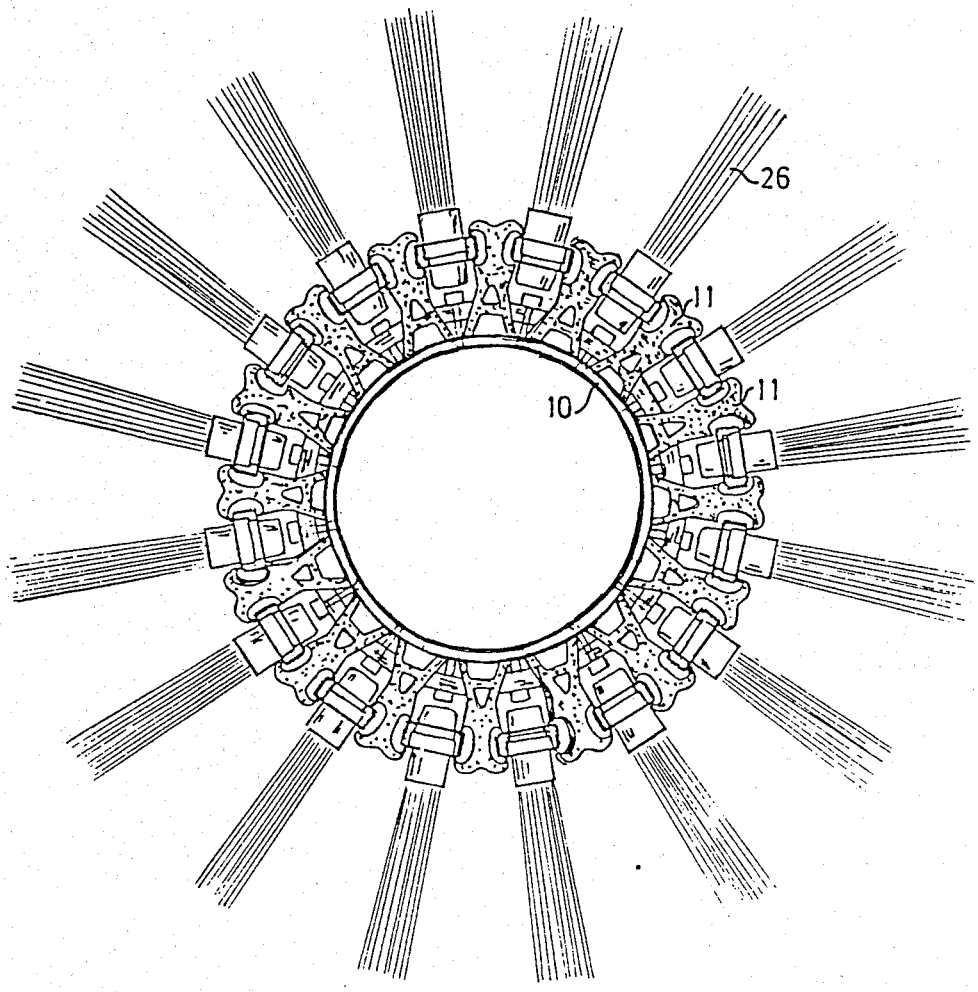
FIG. 1 is an end view of the roller brush.
Figure 2:
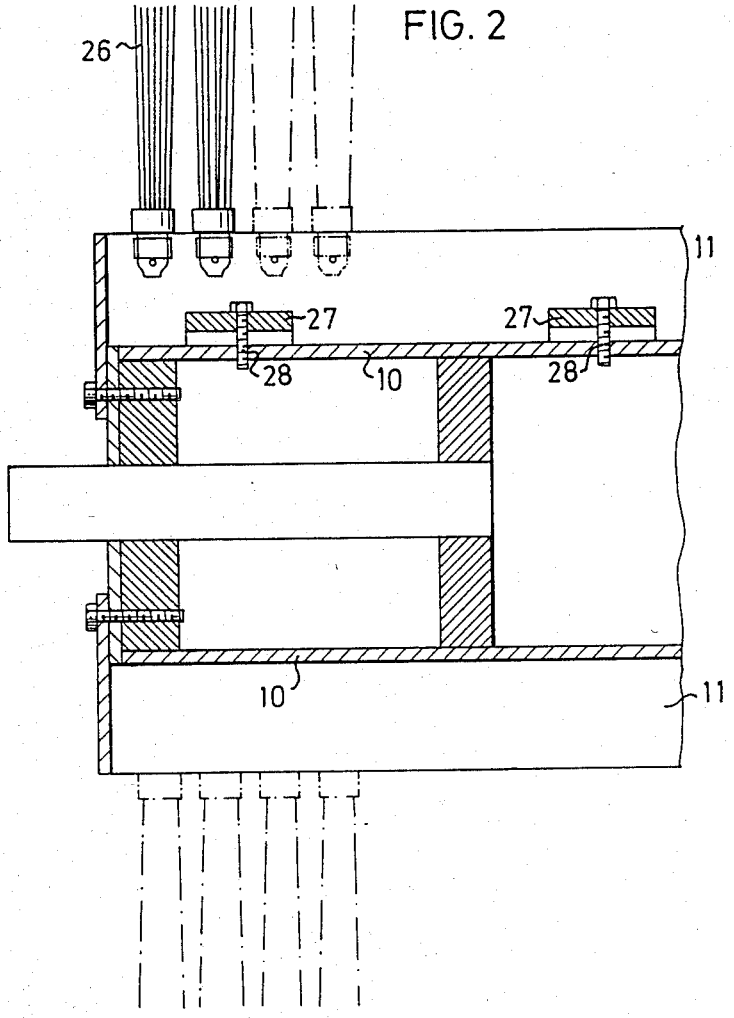
FIG. 2 is a schematic longitudinal section according to line 2—2 in FIG. 1.

The sections are removably clamped to the tube with the aid of a number of wedges 27, tightened down between the sections with the aid of screws 28, which are screwed into threaded holes 29 in the tube. With the aid of the wedges, the sections are clamped tightly to the tube and to each other, and thus form a stiff ring round the tube, as will be seen from FIG. 1.

The light-metal sections result, per se, in that the mass of the roller brush will be considerably greater than in the known roller brush, but in the present case this is only an advantage, taking into account the desire of maintaining uniform rotational speed of the roller brush independent of varying sweeping resistance.

Should a bristle bar or light-metal section be damaged by the roller brush knocking against some obstacle such as a stone, it is easy to loosen the screws keeping the wedges in place and change the damaged detail.

What is claimed is:

1. A roller brush for sweeping machines including a cylindrically shaped central tube carrying a plurality of axially aligned bristle bars, said bristle bars having bristle bundles thereon arranged in rows, the bristles bars having a substantially rectangular cross section with side edges and being displaceably retained by their side edges in axial retaining means, characterized in that a plurality of axially aligned light-metal sections are clamped with equal spacing around the circumference of the cylinder, each of said sections being symmetrical in cross-section and having a foot end engaging portion against the central tube and a radially outward end portion which is provided with axially aligned grooves forming seatings for either side of said outward end portion, each of said foot ends having opposing sides which diverge away from each other in the radial direction toward the central tube to form wedge sufaces, said central tube having threaded holes between said light-metal sections, wedge members having wedge surfaces thereon and being clamped between said light-metal sections by screws tightened down into the threaded holes in the cylinder, the wedge surfaces of the wedge members coacting with the wedge surfaces of the light-metal sections for clamping the light-metal sections against each other into a ring and pressing the ring into rigid engagement against the cylinder, said grooves of the light-metal sections being accommodated by retaining bars formed of plastic material, and wherein each of said retaining bars are formed with channels therein for retaining the side edges of said bristle bars.

* * * * *